US005593207A

United States Patent [19]

Turner

[11] Patent Number: 5,593,207

[45] Date of Patent: Jan. 14, 1997

[54] SEAT FOR CHILD SWING

[75] Inventor: Dennis M. Turner, Scipio, Ind.

[73] Assignee: Cosco, Inc., Columbus, Ind.

[21] Appl. No.: 334,723

[22] Filed: Nov. 4, 1994

[51] Int. Cl.[6] ..... A63G 9/00

[52] U.S. Cl. ..... 297/281; 297/467; 297/369; 297/173

[58] Field of Search ..... 297/487, 488, 297/256.15, 173, 256.1, 256.13, 250.1, 463.1, 368, 273, 281, 467, 174, 170, 369

[56] References Cited

U.S. PATENT DOCUMENTS

| | | | |
|---|---|---|---|
| 463,863 | 11/1891 | Johnson . | |
| 465,275 | 12/1891 | Kennedy et al. . | |
| 648,740 | 5/1900 | Haggard et al. . | |
| 1,231,686 | 7/1917 | Zuniga . | |
| 1,379,566 | 5/1921 | Holland . | |
| 1,544,187 | 6/1925 | Schroeder . | |
| 1,876,111 | 9/1932 | Van Guelphen . | |
| 2,286,784 | 6/1942 | Benzick et al. . | |
| 2,633,895 | 4/1953 | Battles . | |
| 2,851,084 | 9/1958 | Benjetsky . | |
| 2,955,296 | 10/1960 | Zapolski . | |
| 3,054,637 | 9/1962 | Pambello . | |
| 3,366,294 | 1/1968 | Stephenson . | |
| 3,761,126 | 9/1973 | Muholland . | |
| 4,169,626 | 10/1979 | Holler, Jr. . | |
| 4,231,612 | 11/1980 | Meeker . | |
| 4,274,674 | 6/1981 | Deloustal | 297/256.13 |
| 4,323,233 | 4/1982 | Gebhard . | |
| 4,325,578 | 4/1982 | Borucki . | |
| 4,341,420 | 7/1982 | Knowles et al. . | |
| 4,343,510 | 8/1982 | Cone . | |
| 4,376,551 | 3/1983 | Cone . | |
| 4,422,658 | 12/1983 | Hilliard | 297/467 X |
| 4,456,302 | 6/1984 | Knoedler et al. . | |
| 4,545,613 | 10/1985 | Martel et al. . | |
| 4,634,185 | 1/1987 | Kassai . | |
| 4,653,809 | 3/1987 | Czernakowski et al. | 297/250.1 X |
| 4,655,506 | 4/1987 | Wise et al. . | |
| 4,662,683 | 5/1987 | Knoedler et al. . | |
| 4,743,063 | 5/1988 | Foster, Jr. . | |
| 4,744,599 | 5/1988 | Jankowski et al. . | |
| 4,762,364 | 8/1988 | Young . | |
| 4,805,902 | 2/1989 | Casagrande . | |
| 4,807,872 | 2/1989 | Spilman et al. . | |
| 4,858,997 | 8/1989 | Shubin | 297/467 X |
| 4,998,307 | 3/1991 | Cone . | |
| 5,061,012 | 10/1991 | Parker et al. . | |
| 5,092,004 | 3/1992 | Cone et al. . | |
| 5,115,523 | 5/1992 | Cone . | |
| 5,230,523 | 7/1993 | Wilhelm | 297/250.1 X |
| 5,286,086 | 2/1994 | Gunji . | |
| 5,317,765 | 6/1994 | Knoedler et al. . | |
| 5,320,416 | 6/1994 | Kornberg . | |
| 5,326,327 | 7/1994 | Stephens et al. . | |
| 5,334,099 | 8/1994 | Marra et al. . | |

*Primary Examiner*—Milton Nelson, Jr.
*Attorney, Agent, or Firm*—Barnes & Thornburg

[57] ABSTRACT

A child seat is provided having an adjustable seat back arranged to pivot relative to a seat bottom between an upright position and a reclined position. The child seat includes a seat shell having a proximal end, a distal end, a seat bottom, and a first pivot axis adjacent to the proximal end and positioned to lie in spaced-apart relation to the seat bottom. A bottom surface of the seat shell includes a nesting surface appended to the proximal end of the seat shell. The nesting surface curves along an arc having a radius that is constant about the first pivot axis. The child seat also includes a seat back shell having a proximal end, a distal end, a seat back, and a second pivot axis adjacent to the distal end and lying in spaced-apart relation to the seat back. A top surface of the seat back shell includes a mating surface appended to the distal end of the seat back shell. The mating surface curves along an arc having a radius that is constant about the second pivot axis defining a shell-receiving cavity adjacent to the distal end of the seat back shell. The seat back shell is rotatably appended to the seat shell and the proximal end of the seat shell is positioned to lie in the seat shell-receiving cavity. The first pivot axis is coincident with the second pivot axis and the nesting surface engages the mating surface.

46 Claims, 7 Drawing Sheets

SEAT FOR CHILD SWING

BACKGROUND AND SUMMARY OF THE INVENTION

The present invention relates to a child seat, and particularly to a child seat for use on a child swing. More particularly, the present invention relates to a child seat having an adjustable seat back arranged to assume several positions relative to a seat bottom of the child seat, a support structure for appending the child seat to support arms appended to a swing motor of a child swing, and a child restraint apparatus to prevent the child from inadvertently sliding off of the front edge of the child seat.

Child seats that adjust a child's position by pivoting the seat back relative to the seat bottom are well known in the art. For example, U.S. Pat. No. 4,998,307 to Cone, U.S. Pat. No. 4,762,364 to Young, U.S. Pat. No. 4,325,578 to Borucki, U.S. Pat. No. 3,366,294 to Stephenson, U.S. Pat. No. 3,054,637 to Pambello, and U.S. Pat. No. 1,876,111 to Van Guelpen all disclose child seats having seat backs that are adjustable relative to the seat bottoms.

Further, child seats for use on child swings are widely accepted, and child swings having child seats are also well known in the art. For example, U.S. Pat. No. 4,807,872 to Spilman et al., U.S. Pat. No. 4,325,578 to Borucki, U.S. Pat. No. 4,323,233 to Gebhard, U.S. Pat. No. 1,544,187 to Schroeder, U.S. Pat. No. 1,379,566 to Holland, U.S. Pat. No. 1,231,686 to Zuniga, U.S. Pat. No. 648,740 to Haggard et al., U.S. Pat. No. 465,275 to Kennedy et al., and U.S. Pat. No. 463,863 to Johnson all disclose child swings having child seats for use on the child swings.

What is needed is a child seat having an adjustable seat back capable of being fixed at a number of positions between a reclined position and an upright position. Ideally, such a child seat could be formed to include a support-receiving structure for mounting the child seat to support arms appended to a swing motor. Also, such a child seat would include a child restraint apparatus movable between an upright child-restraining position above the seat bottom and an unobtrusive child-releasing position.

According to the present invention, a child seat is provided for a swing. The child seat includes a seat shell having a seat bottom with a front edge and a back edge. An adjustable seat back is pivotably appended to the back edge of the seat bottom and extends upwardly from the seat bottom. The child seat further includes swing support-receiving structures that are arranged to receive support arms appended to a swing motor. The support arms and the support-receiving structures cooperate to suspend the child seat above a floor. Additionally, the child seat includes a rotatable restraint bar that is usable to restrain a child seated in the seat shell.

The adjustable seat back is adjustable between an upright position and a reclined position. The adjustable seat back includes a mechanism for locking the seat back in several positions relative to the seat bottom. The locking mechanism has a peg mounted to the seat back. The peg reciprocates between a seat back-locking position and a seat back-unlocking position. The seat shell further includes a wall arranged to define a peg-receiving notch. The peg-receiving notch receives the peg when the peg is in the seat back-locking position. The peg and the peg-receiving notch cooperate to fix the seat back relative to the seat shell when the peg is received by the peg-receiving notch.

Advantageously, the adjustable seat back is formed in a seat back shell that is pivotably appended to the seat shell. The seat shell has a proximal end and a distal end. The seat shell further includes two spaced-apart side edges positioned to lie between the proximal end and the distal end. Two side arms are appended to the side edges and extend upwardly therefrom. A first pivot axis lies in spaced-apart relation to the seat bottom adjacent to the proximal end and intersects both side arms. A bottom surface of the seat shell includes a nesting surface adjacent to the proximal end. The nesting surface is arranged to curve along an arc having a radius that is constant about the first pivot axis.

The seat back shell also has a proximal end and a distal end. The seat back shell further includes two spaced-apart side edges positioned to lie between the proximal end and the distal end. Two side arms are appended to the side edges and extend upwardly therefrom. A second pivot axis lies in spaced-apart relation to the seat back adjacent to the distal end and intersects both side arms. A top surface of the seat back shell includes a mating surface adjacent to the distal end. The mating surface is arranged to curve along an arc having a radius that is constant about the second pivot axis. The curvature of the mating surface provides the seat back shell with a shell-receiving cavity adjacent to the distal end of the seat back shell.

The seat back shell is rotatably appended to the seat shell. The proximal end of the seat shell is positioned to lie in the shell-receiving cavity. The seat shell and the seat back shell are arranged so that the first pivot axis and the second pivot axis are coincident and the nesting surface fully engages the mating surface when the seat back is in the reclined position.

In preferred embodiments, the pivot axis lies in a transverse direction across the seat shell and the seat back shell. Also, the child seat includes a longitudinal dimension perpendicular to the transverse direction. As the care giver pivots the seat back shell relative to the seat shell the nesting surface slides over the mating surface. Though the size of an overlapping area of the nesting surface and the mating surface changes as the seat back shell pivots relative to the seat shell, the nesting and mating surfaces remain in full engagement in overlapping area through the full range of movement of the seat back shell relative to the seat shell 28.

Illustratively, an adjustable seat back in accordance with the present invention is pivotably mounted to a seat bottom included in a child seat for use on a child swing. It is within the scope of the present invention to include such an adjustable seat back in a wide variety of child-supporting units such as car seats, high chairs, car beds, child carriers, strollers, and other types of child seats.

Ideally, two locking mechanisms for locking the seat back relative to the seat bottom are provided with the child seat in accordance with the present invention. One mechanism is appended to the seat shell adjacent to the first side arm and the second mechanism is appended to the seat shell adjacent to the second side arm. Also, the pegs are preferably appended to spring assemblies which are appended to the seat back shell. The spring assemblies urge the pegs to seat back-locking positions in which the pegs are inserted into peg-receiving notches. Release handles, each of which is movable between a peg-inserting position and a peg-releasing position, are appended to the spring assemblies. The release handles move the pegs from the seat back-locking positions to seat back-unlocking positions.

When the care giver wishes to adjust the position of the seat back, the care giver grasps the child seat with both hands placing one hand on the first side arm and the other hand on the second side arm. The release handles are arranged so that the care givers fingers will engage the release handles. The care giver then simply squeezes the release handles to unlock the seat back-locking mechanisms, adjusts the seat back to the desired position relative to the seat bottom, and releases the release handles to lock the seat back-locking mechanisms and fix the seat back relative to the seat bottom.

The nesting and mating surfaces of the seat shell and the seat back shell cooperate with the locking mechanisms, including the pegs appended to the seat back shell and the peg-receiving notch formed in the seat shell, to provide a child seat with an adjustable seat back. The seat back is pivotable relative to the seat shell and can be selectively locked relative to the seat shell when the care giver allows the peg to be received by the peg-receiving notch.

The seat shell can be formed to include more than one peg-receiving notch. Each peg-receiving notch formed in the seat shell and positioned to receive the peg when the seat back is in a position between the upright position and the reclined position provides an additional intermediate position in which the seat back can be fixed to the seat shell. The seat back can be arranged to be fixed is as many positions as desired between the upright position and the reclined position for which there is room to form notches in the seat shell Construction of the child seat using a seat shell having a nesting surface and a seat back shell having a mating surface is particularly advantageous. The mating surface and a top surface of the seat back shell adjacent to the nesting surface provide an essentially smooth and continuous seating surface for the child. As the seat back is pivoted relative to the seat bottom, the top surface of the seat shell and the mating surface of the seat back shell continue to provide an essentially smooth and continuous seating surface. The top surface and the mating surface are arranged so that adjustments of the seat back are essentially imperceptible underneath a child seated in the seat shell so that the only change noticed by the child is the child's change of position.

The seat back locking mechanism cooperates with the seat shell and the seat back shell to provide a child seat that can be easily adjusted between several positions without causing discomfort or significant shifting of the child. The seat back can be fixed in several positions relative to the seat bottom and can easily be adjusted and locked into a different position by the care giver.

The seat shell further includes the support-receiving structure which is appended to the seat shell and is arranged to receive support arms appended to a swing motor. The support arms and the support-receiving structure are arranged to suspend the seat above a floor.

The seat shell and the side arms appended to the seat shell further include a bottom surface. Each side arm includes an inner side wall, a top wall appended to a top edge of the inner side wall, and an outer side wall appended to the top wall. The inner side wall, the top wall, and the outer side wall cooperate to define a downwardly opening U-shaped channel. The support-receiving structure is disposed within the U-shaped channel and is appended to the bottom surface underneath the top wall.

The support receiving structure includes a U-shaped bridge and an inverted U-shaped bracket positioned to lie in spaced-apart relation to the bridge. The bridge and the bracket are each appended to a bottom surface of the top wall. In preferred embodiments, a second U-shaped bridge is appended to the bottom surface of the top wall between the first bridge and the first bracket, and a second inverted U-shaped bracket is appended to the bottom surface of the top wall adjacent to the first bridge, with the first bridge positioned to lie between the second bracket and the second bridge.

The support arms include mounting ends that are formed so that a transverse cross section of the mounting ends are non-circular. The support-receiving structures are arranged to receive the non-circular mounting ends. The non-circular shape of the mounting ends of the support arms cooperate with the corresponding shape of the support-receiving structures to fix the support arms and render the support arms unable to rotate relative to the seat shell.

Illustratively, a child seat having an adjustable seat back in accordance with the present invention is intended for use on a child swing. However, it is within the scope of the present invention to include such an adjustable seat back in a wide variety of child-supporting units such as car seats, high chairs, car beds, child carriers, strollers, and other types of child seats.

For the reasons described above, use of the support structures of the present invention on a child seat for use on a child swing eliminates the twisting and yaw movement of the child seat and the support arms. Typically when mounting a child seat to a swing frame structure it is necessary to improve the stability of the structure by providing an additional support member apart from the seat shell and arranged to directly connect support arms that are received on both sides of the child seat. However, the structural stability provided by the support structures of the present invention permits mounting a child seat to a child swing without providing any member apart from the seat shell to directly connect the two mounting arms. As a result, use of the support structures of the present invention simplifies the design and the assembly of the child seat.

In preferred embodiments, the child seat further includes a rotatable restraint bar that is usable to restrain a child seated in the seat shell. The restraint bar includes a post having a base, a tip, and a stop tab appended to the base. The base of the post is mounted for rotation to the seat shell. The base is arranged so that the tip swings easily along an arc between a child-restraining position above the seat bottom and a child-releasing position in which the stop tab engages the seat shell. In preferred embodiments, the restraint bar is T-shaped and includes a transverse cross member having a top wall arranged to define a tray having a flat upwardly-facing top surface and a lip surrounding the perimeter of the top surface, the transverse cross member being appended to the tip of the rotatable post.

Advantageously, a child seat for a swing is provided. The child seat includes an adjustable seat back that is pivotably appended to the seat bottom, swing support-receiving structures that are arranged to receive support arms appended to a swing motor, and a rotatable restraint bar that is usable to restrain a child seated in the seat shell. Consumers will appreciate the convenience and the ease of use of the various features of this child seat. Manufacturers will likewise appreciate the ease of assembly provided by the designs of the various component elements of this child seat.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
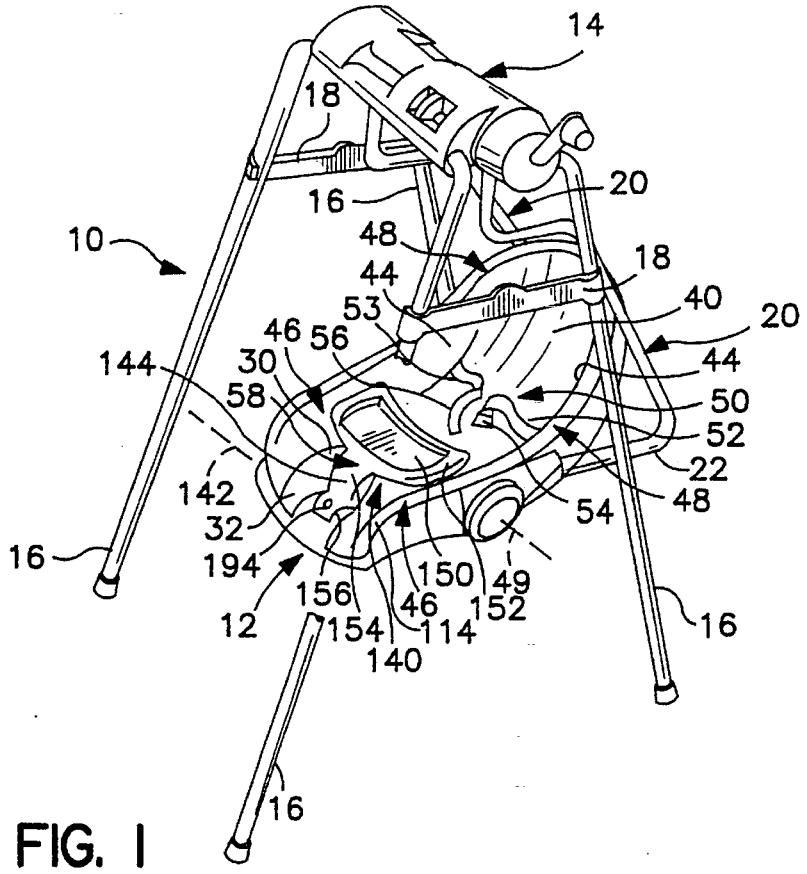
FIG. 1 is a perspective view of a child swing showing a frame resting on a floor and having a housing encasing a swing motor mounted on the top of the frame, two seat supports appended to the swing motor, and a child seat in accordance with the present invention having a T-shaped restraint bar mounted to the front of the child seat, the child seat being mounted on the seat supports and suspended above the floor.

An illustration of a child swing 10 having a child seat 12 in accordance with the present invention is shown in FIG. 1. The child swing 10 includes a housing 14 encasing a swing motor (not shown). Legs 16 are appended to the housing 14 and are arranged to support the housing 14 while suspending the housing 14 over a surface, typically a floor of a room. Two struts 18 are appended to the legs 16 to provide additional stability to the child swing 10. Two seat supports 20 having horizontal support arms 22 are appended to the swing motor. Two support structures 24 appended to the bottom side 26 of the child seat 12 receive the support arms 22 as shown in FIGS. 2–5. The support structures 24 cooperate with the seat supports 20 to suspend the child seat 12 over the surface.

Figure 6:
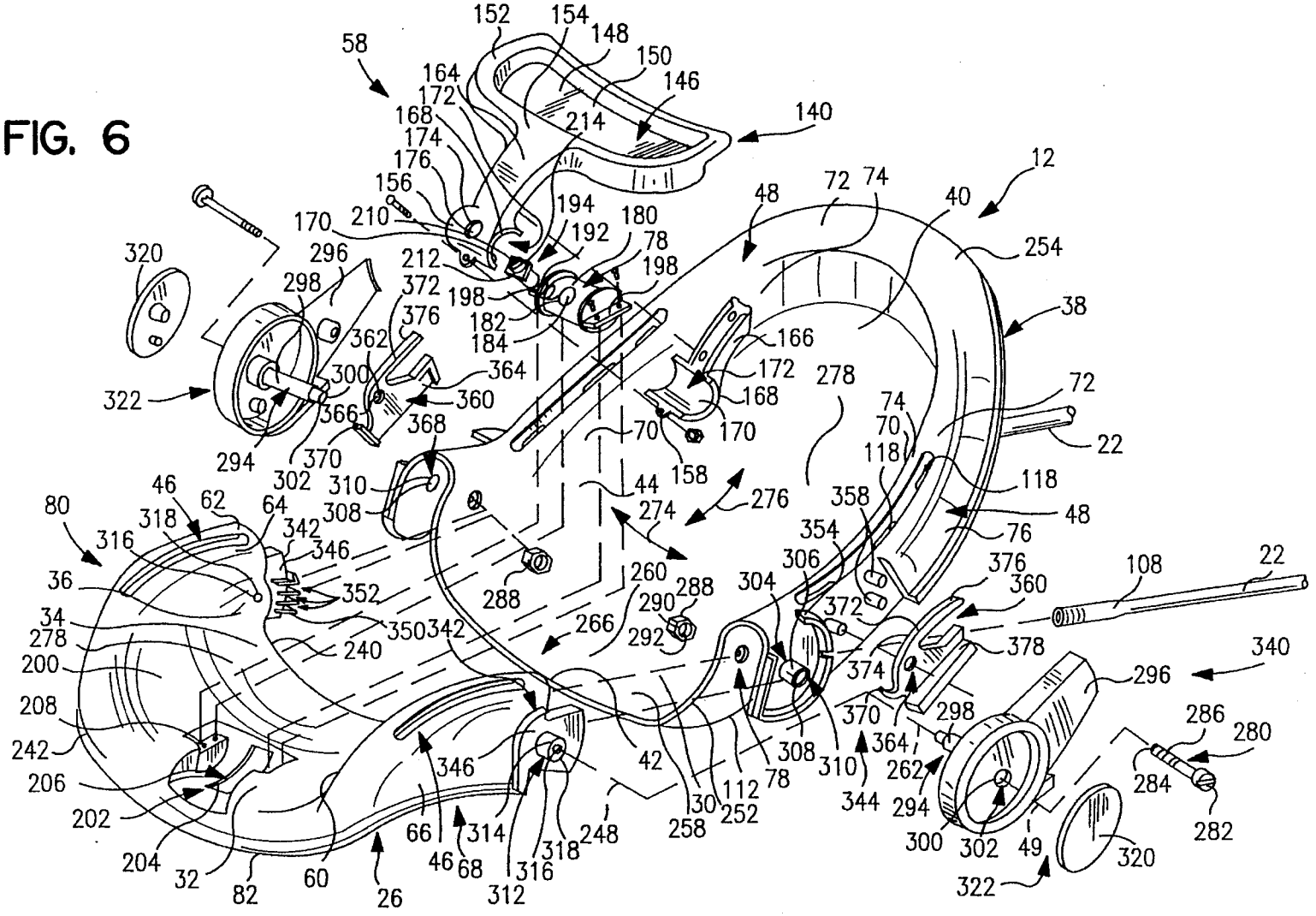
FIG. 6 is an exploded perspective view of the child seat of FIG. 1 showing a seat bottom having side arms, a seat back having side arms, a T-shaped restraint bar having a restraint bar mounting and locking mechanism movable along the dotted lines to mount to a front edge of the seat shell, two squared C-shaped spring assemblies arranged to be mounted to the sides of the seat back, two notch assemblies appended to the sides of the seat bottom having teeth arranged to define peg-receiving notches, and two support arms appended to seat supports (not shown), the support arms being movable along the dotted lines to be received by the support structures hidden from view underneath the sides of the seat bottom.

The child seat 10 includes a seat shell 28 formed to include a seat bottom 30 having a front edge 32, a back edge 34, and two side edges 36 therebetween, and a seat back shell 38 formed to include a seat back 40 having a front edge 42 and two side edges 44, as shown best in FIG. 6. Two spaced-apart side arms 46 are appended to the side edges 36 of the seat bottom 30 and extend upwardly therefrom, and two additional spaced-apart side arms 48 are appended to the side edges 44 of the seat back 40 and extend upwardly therefrom. The side arms 48 of the seat back shell 38 are pivotably mounted to the side arms 46 of the seat shell 28 so that the seat back shell 38 pivots relative to the seat shell 28 about a pivot axis 49. The front edge 42 of the seat back 40 is adjacent to the back edge 34 of the seat bottom 30 when the seat back shell 38 is mounted to the seat shell 28.

The child seat 10 further includes a first restraint 50, shown best in FIG. 1. The first restraint 50 has two straps 52, 53 appended to the seat back shell 38. The straps 52, 53 are joined together by a buckle 54 carried on one strap 52 and a tongue 56 carried on the other strap 53 during use. In addition to the first restraint 50, the child seat 10 includes a T-shaped restraint bar 58 to prevent a child (not shown) seated on the seat bottom 30 in the seat shell 28 from sliding past the front edge 32 of the seat bottom 30.

Each side arm 46 appended to the seat bottom 30 has an inner side wall 60, a top wall 62 appended to a top edge 64 of the inner side wall 60 and an outer side wall 66 appended to the top wall 62. Likewise, each side arm 48 appended to the seat back 40 has an inner side wall 70, a top wall 72 appended to a top edge 74 of the inner side wall 70, and an outer side wall 76 appended to the top wall 72. The inner and outer side walls 60, 70 and 66, 76 and the top walls 62, 72 of the side arms 46, 48 cooperate to define downwardly opening U-shaped channels 68, 78, as shown in FIGS. 2–6.

A wall 80 of the seat shell 28 is formed to include a bottom surface 82 positioned to lie underneath the child seat 12. The support structures 24 are disposed within the U-shaped channels 68 of the seat shell 28 and are appended to the bottom surface 82, as shown best in FIG. 2. The support structures 24 include a first U-shaped bridge 84, a second U-shaped bridge 86, a first inverted U-shaped bracket 88, and a second inverted U-shaped bracket 90. The first and second bridges 84, 86 each include a wall 92 arranged to define a support arm-receiving channel 94, and the first and second brackets 88, 90 each include a wall 100 having a surface 96 arranged to define support arm-receiving openings 98.

The wall 100 of the first bracket 88 includes an edge 102 arranged to define an opening 104 sized to receive a threaded fastening device 106. Each support arm 22 rests in a support arm-receiving opening 98 and is fastened to the support structure 24 by threaded fastening devices 106, as shown best in FIGS. 2 and 5. Though threaded fastening devices 106 are disclosed for fastening the support arms 22 to the support structures 24, any other suitable fastening method such as gluing or riveting the support arms 22 to the support structures 24 is within the scope of the invention as presently perceived.

Figure 4:
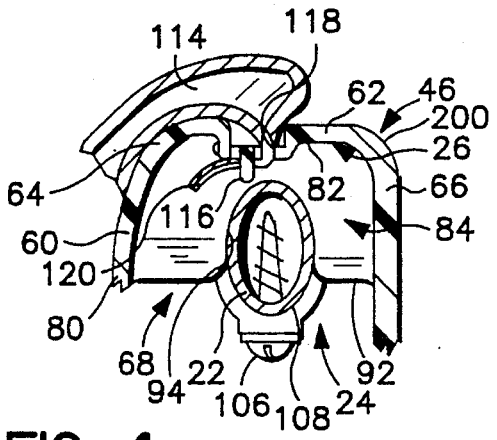
FIG. 4 is a sectional view taken along line 4—4 of FIG. 2 showing an oval cross section of the support arm in engagement with the bridge, a bracket positioned to lie behind the bridge, a bolt securing the support arm to the bracket, and fabric threaded through an opening and secured by a loop to a post.
Figure 5:
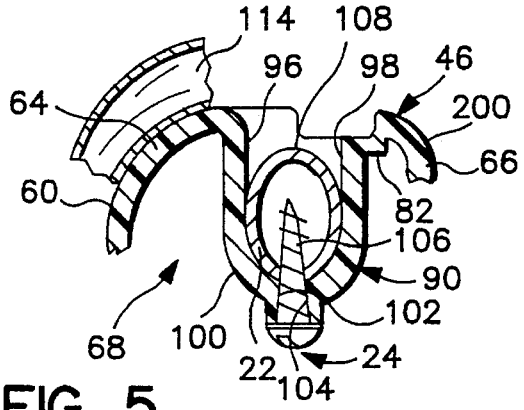
FIG. 5 is a sectional view taken along line 5—5 of FIG. 2 showing an oval cross section of the support arm in engagement with the bracket, a bolt securing the support arm to the bracket, and fabric in engagement with the side arm.
Figure 2:
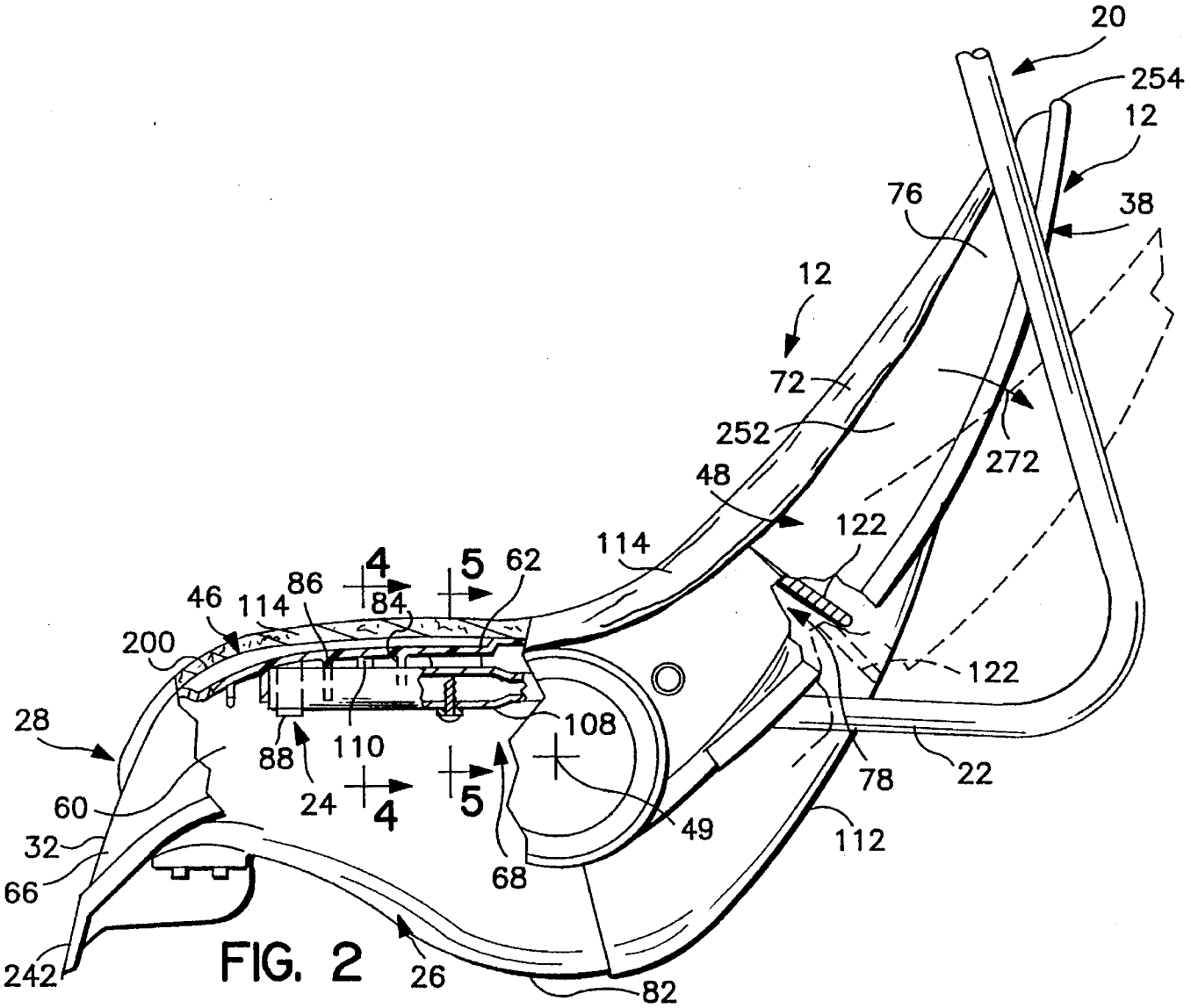
FIG. 2 is a side view of the child seat of FIG. 1 with a portion broken away showing a horizontal support arm bolted to a support structure underneath a side arm of a seat shell and a stop appended to the rear of a seat back shell and arranged to engage the support arm to stop the downward motion of the seat back shell.
Figure 3:
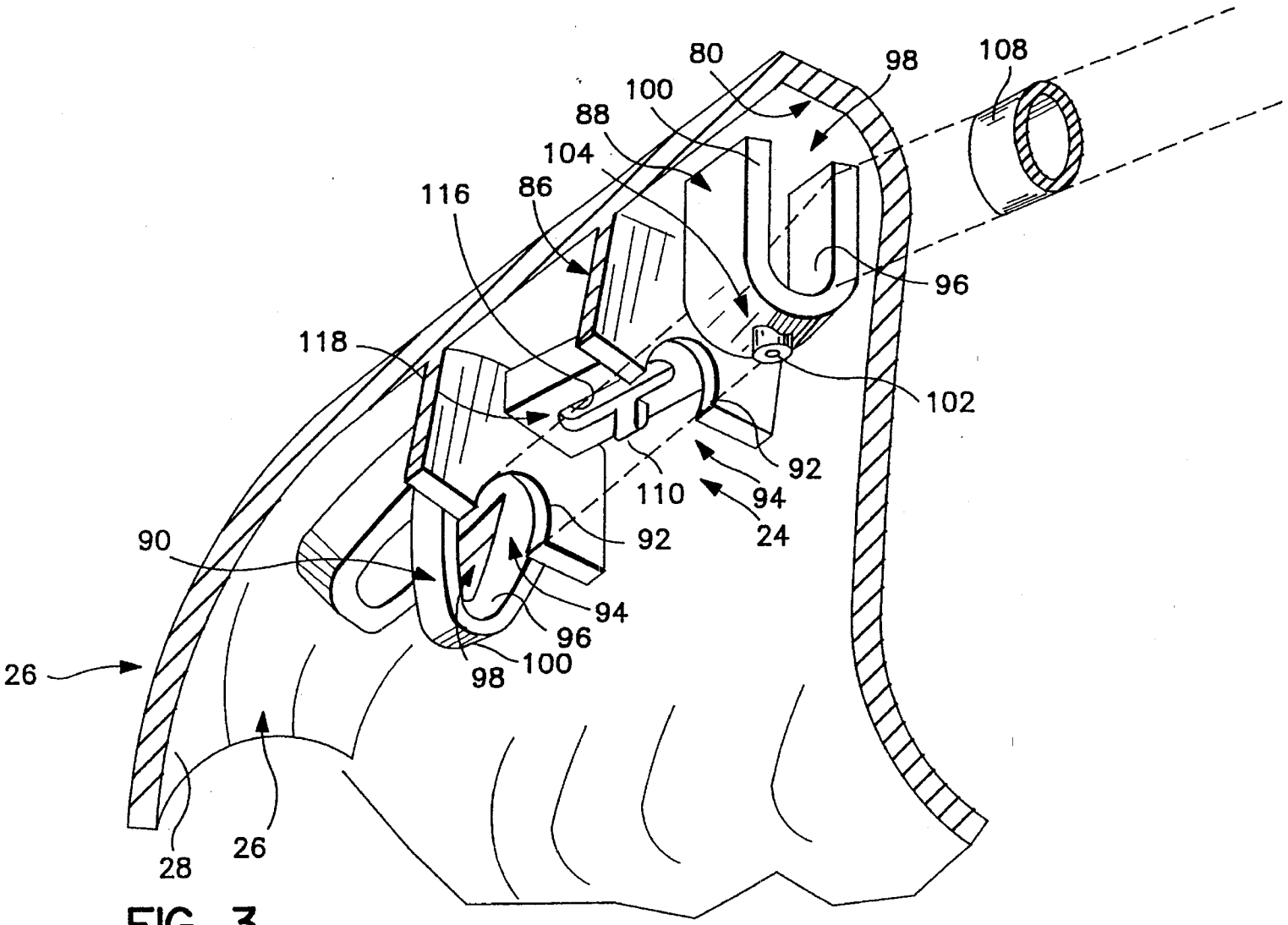
FIG. 3 is an inverted perspective view of the support structure of FIG. 2 with a portion broken away showing two spaced-apart U-shaped bridges having support arm-receiving recesses and two inverted U-shaped brackets having support arm-receiving openings, the brackets being positioned to lie in spaced apart relation to the two bridges.

Each support arm 22 has a mounting end 108 arranged to engage the support structure 24, shown best in FIGS. 2 and 4–6. The mounting ends 108 are shaped so that a cross section taken along a line that is perpendicular to the support arm 22 reveals a non-circular cross section. In preferred embodiments, the mounting ends 108 are shaped so that these cross sections are oval, as shown best in FIGS. 4 and 5, though any non-circular shape arranged to prevent rotational movement of the support arms 22 relative to the support structures 24 is within the scope of the invention as presently perceived. The walls 92 of the bridges 84, 86 and the surfaces 96 of the brackets 88, 90 are arranged so that the support arm-receiving channels 94 and the support arm-receiving openings 98 are shaped to correspond to the cross sectional shape of the mounting ends 108 as shown in FIGS. 2, 4, and 5.

The non-circular shapes of the mounting ends 108 and the corresponding shapes of the support arm-receiving channels 94 and the support arm-receiving openings 98 cooperate to eliminate any movement of the support arms 22 independent of the seat shell 28 and hence any movement of the support arms 24 independent of one another. As a result, the seat shell 28 performs the same function that one strut fixed to both support arms 24 would perform, that being the function of fixing the support arms 24 to one another to eliminate twisting of the support arms 24 and any other independent movement of the support arms 24 that could result in yaw or other undesired motion of the child seat 12 of the child swing 10. Use of the support structures 24 of the present invention eliminates the need for any additional frame members to couple the support arms 24, thereby lowering the number of parts needed to mount the child seat 12 of the present invention for use on a child swing 10.

Cover-receiving posts 110 are appended to the bottom surface 82 of the seat shell 28 as well as to a bottom surface 112 of the seat back shell 38, with one cover-receiving post 110 being adjacent to the support structures 24, as shown best in FIGS. 2–5. The child seat 12 is covered by a cover 114 to enhance the comfort of a child (not shown) seated in the shells 28, 38 as well as to enhance the aesthetic appearance of the child seat 12. The top walls 62, 72 include several edges 116 arranged to define spaced-apart loop-receiving apertures 118 as shown best in FIGS. 3 and 4. The loops 120 which are appended to the cover 114 penetrate the loop-receiving apertures 118 and engage the cover-receiving posts 110 and to hold the cover onto the child seat 12.

A stop bar 122 is disposed in the U-shaped channel 78 of the seat back shell 38 and is appended to the bottom surface 82 of the top wall 72, as shown best in FIG. 2. The stop bar 122 engages the support arm 22 to stop the reclining motion of the seat back 40 once the seat back is reclined to a predetermined position, shown best in FIG. 2. The extent to which the child seat 12 can recline is dependent upon the size of the stop bar 122 and the placement of the stop bar 122 in the U-shaped channel 78. If the stop bar 122 is shortened or moved away from the pivot axis 49, the seat back 40 will recline to a greater extent before the stop bar 122 engages the support arm 22 to prevent further movement of the seat back 40. Likewise, if the stop bar 122 is lengthened or moved closer to the pivot axis 49, the seat back 40 will recline to a lesser extent before the stop bar 122 engages the support arm 22.

Figure 7:
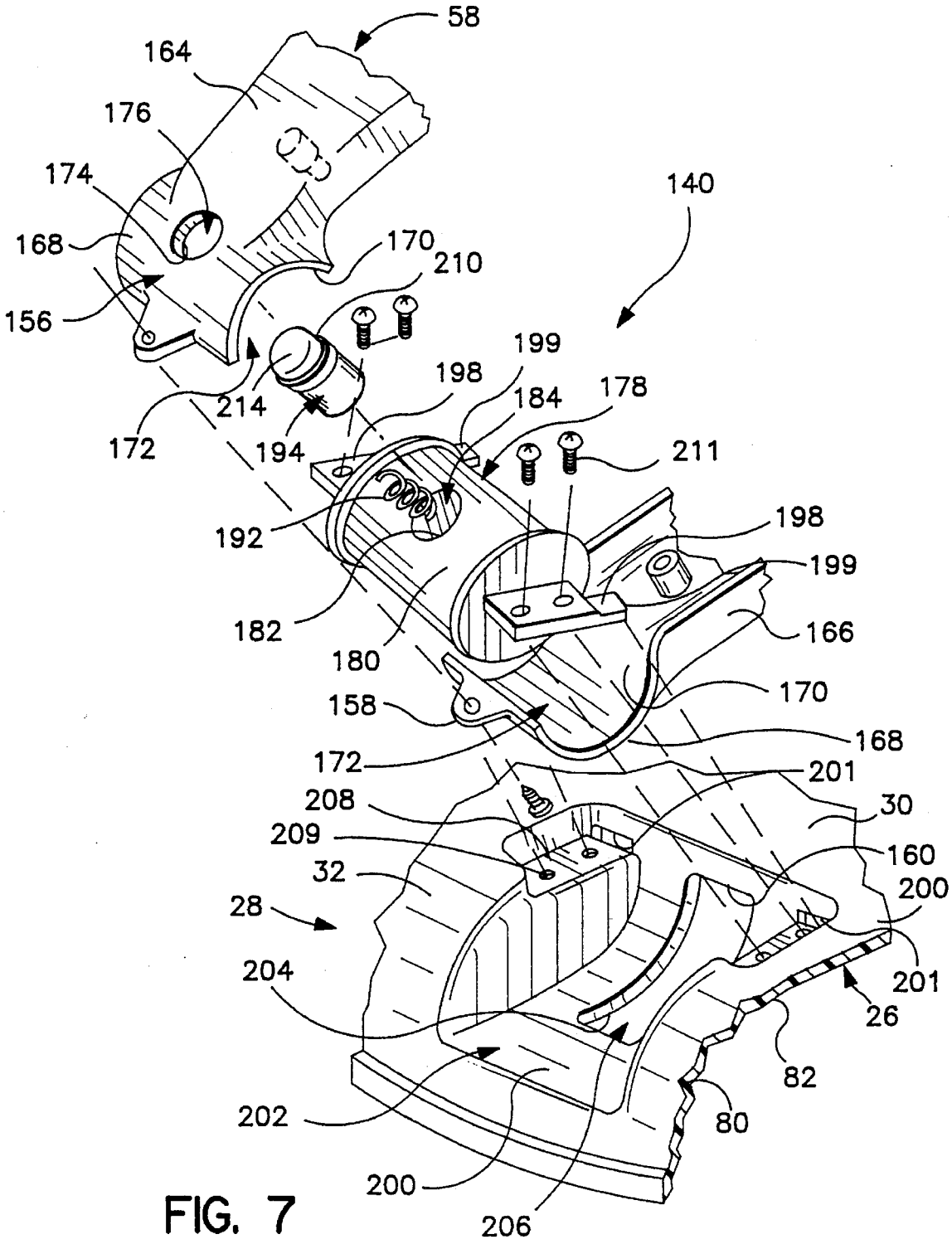
FIG. 7 is an exploded view of the mounting and locking mechanism of the T-shaped restraint bar showing a barrel-shaped button housing including mounting wings appended to the sides of the button housing and a cylindrical button chamber formed in the housing, a spring and a button positioned to lie in the chamber, two halves of a base of the T-shaped restraint bar, and a front edge of the child seat including a wall arranged to define a mounting site for both the button housing and the base of the T-shaped restraint bar.
Figure 8:
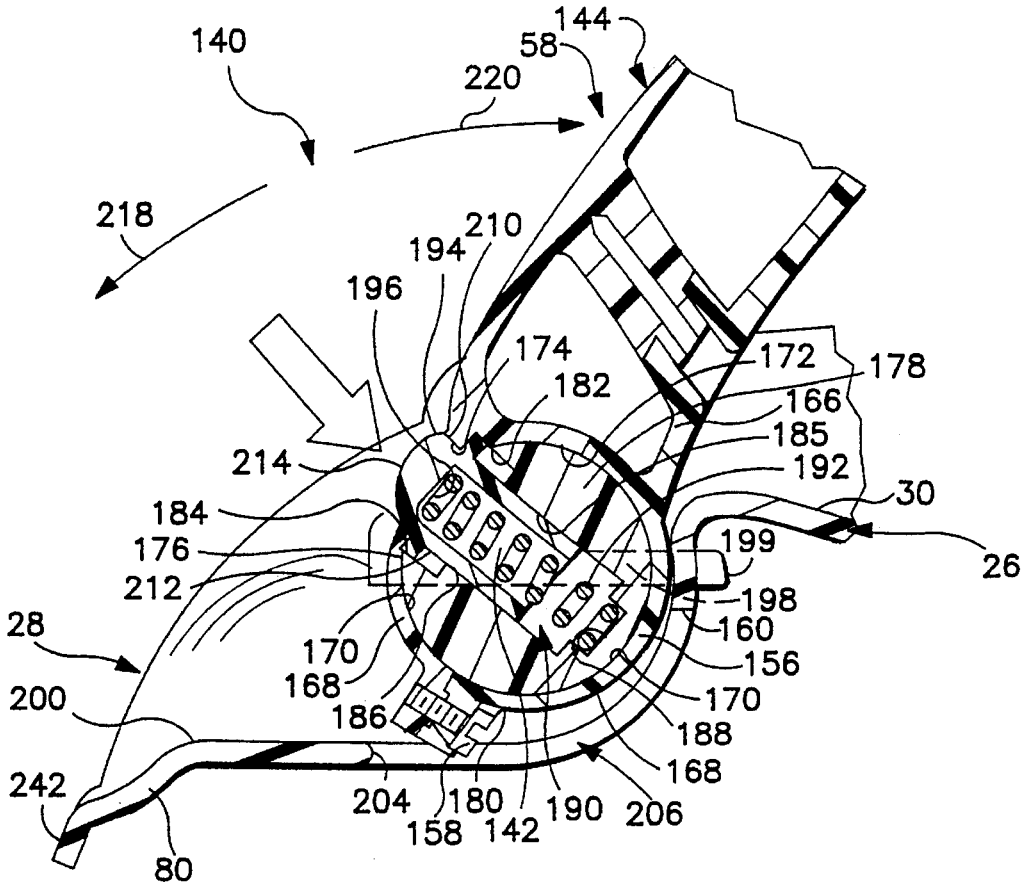
FIG. 8 is a sectional view taken along line 8—8 of FIG. 1 showing the mounting and locking mechanism of the T-shaped restraint bar in a restraint bar-locking position having the button protruding through an opening formed in the base and in engagement with an edge of the opening of the base to prevent rotation of the T-shaped restraint bar about a pivot axis.
Figure 9:
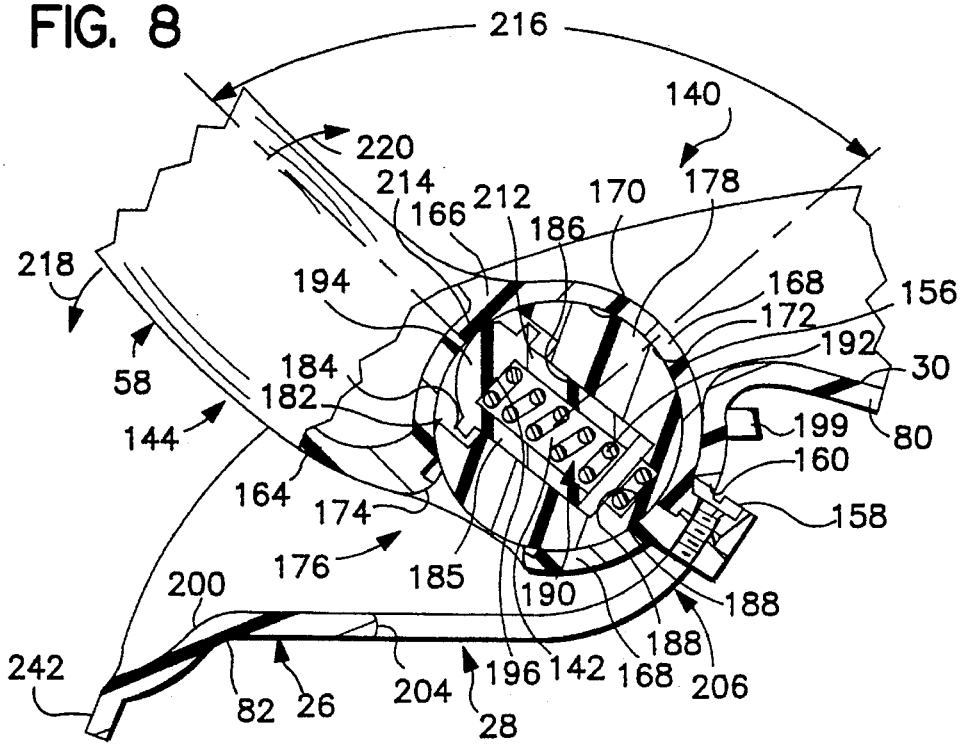
FIG. 9 is a view similar to FIG. 8 showing the button enclosed by the side wall of the base and having a top surface of the button in engagement with the side wall, thereby allowing the T-shaped restraint bar to rotate about the pivot axis.

A child restraint apparatus 140 is mounted for rotation to a front edge 32 of the seat bottom 30 as shown in FIGS. 1 and 6–9. The child restraint apparatus 140 can be rotated about a pivot axis 142 to assume either a child-releasing position as shown in FIG. 9 or an upright child-restraining position above the seat bottom 30 as shown in FIGS. 1 and 8.

The rotatable child restraint apparatus 140 includes a T-shaped restraint bar 58 having a post 144 and an elongated transverse cross member 146 appended to the post 144. The transverse cross member 146 is arranged to lie in perpendicular relation to the post 144. Illustratively, the cross member 146 includes a top wall 148 arranged to define an upwardly facing flat surface 150 surrounded by a lip 152 on the perimeter of the flat surface 150 as shown, for example, in FIGS. 1 and 6, so that the cross member 146 has a shape of a tray. The post 144 includes a distal tip 154 and a base 156 rotatably mounted to the front edge 32 of the seat bottom 30 and formed to include a stop tab 158 as shown in FIGS. 1 and 6–9.

When placing a child onto the seat bottom 30 or removing a child from the seat bottom 30, the rotatable T-shaped restraint bar 58 is ideally placed in the child-releasing position illustrated in FIG. 9 placing the stop tab 158 in engagement with a stop 160 on the seat shell 28. This position provides a care giver with convenient access to the seat bottom 30 when seating a child (not shown) on or removing a child from the seat bottom 30.

Once the child (not shown) is placed onto the seat bottom 30 of the seat shell 28, the care giver swings the T-shaped restraint bar 58 upwardly about a pivot axis 142 until the T-shaped restraint bar 58 is automatically locked to the seat shell 28 so that it is retained in the upright child-restraining position illustrated in FIGS. 1 and 8. In this position, the post 144 of the T-shaped restraint bar 58 will be disposed in front of and between the legs of a child seated in the seat shell 28, with the tip 154 and the cross member 146 positioned to lie above the seat bottom 30 and in laterally spaced-apart relation to the seat back 40. In the upright child-restraining position, the T-shaped restraint bar 58 provides a restraint to stop the forward motion of a child seated in the seat shell 28 that might otherwise slide forward past the front edge 32 of the seat bottom 30.

To remove a child from the seat shell 28, the care giver simply depresses a release button 194 shown in FIG. 2 and mounted on post 144 in the manner described below to unlock the T-shaped restraint bar 58 so that it is movable relative to shell 12. Next, the care giver swings the T-shaped restraint bar 58 about pivot axis 142 to the child-releasing position illustrated in FIG. 1 and allows the stop tab 158 to rest against the stop 160 on the seat shell 28. Again, with the T-shaped restraint bar 58 in the child-releasing position, the care giver obtains convenient access to the seat shell 28, maximizing the ease and convenience of placing the child in or removing the child from the seat shell 28.

The child restraint apparatus 140 is shown in greater detail in FIGS. 6–9. Illustratively, the T-shaped restraint bar is of two-piece construction having a tray piece 164 and a back plate 166. The base 156 of the post 144 includes a wall 168 having an interior surface 170 arranged to define a cylindrical interior region 172. The wall 168 also includes an edge 174 arranged to define a button-receiving aperture 176.

Referring to FIG. 7, a cylindrical button housing 178 includes a wall 180 having an edge 182 arranged to define an opening 184. The wall 180 is arranged to define an internal tubular button container 185 as shown in FIGS. 8 and 9. Button container 185 includes a cylindrical side wall 186 integrally appended to the edge 182 of the wall 180 and a bottom wall 188 integrally appended to the side wall 186. The side wall 186 and the bottom wall 188 are arranged to define a chamber 190 in tubular button container 185.

A release button 194 is mounted for sliding movement in the chamber 190 formed in the button container 185 and is urged radially outwardly by a compression spring 192 also situated in the button container 185. The spring 192 is positioned inside the chamber 190 as shown, for example, in FIGS. 7–9, to engage both the bottom wall 188 of the chamber 190 and an opposing bottom wall 196 of the release button 194. The button housing 178 is received in the interior region 172 of the base 156 of the post 144. The button housing 178 and the interior surface 170 of the wall 168 of the base 156 cooperate to rotatably mount the base 156 to the button housing 178.

The button housing 178 further includes two mounting wings 198 and a tab 199 appended to each wing 198, as shown, for example, in FIG. 7. The wall 80 of the seat shell 28 further includes a top surface 200 having a cylindrically shaped restraint bar-receiving surface 205 arranged to define a restraint bar-receiving hollow 202 adjacent to the front edge 32 of the seat bottom 30. The restraint bar-receiving hollow 202 is sized to accept the base 156 of the post 144.

The wall 80 further includes an edge 204 arranged to define a stop tab-receiving slot 206 and edges 201 arranged to define tab-receiving apertures 203. The stop 160 that engages the stop tab 158 when the post 144 is in the child-releasing position is appended to the edge 204 adjacent to the slot 206.

The restraint bar-receiving surface 205 is additionally formed to include two pedestals 208, each pedestal 208 having threaded fastener-receiving apertures 209. The mounting wings 198 of the button housing 178 are fixed to the pedestals 208 by threaded fasteners 211 received by the apertures 209. The tabs 199 on the mounting wings 198 are received by the tab-receiving apertures 203, and the stop tab 158 is received in the stop tab-receiving slot 206.

The base 156 is free to rotate about the button housing 178 and is positioned to pivot about the pivot axis 49 as the tip 154 of the post 144 swings between the child-restraining position shown in FIG. 8 and the child releasing position shown in FIG. 9. The angular range 216 of the rotating movement of the base 156 is limited in the downward direction 218 by the engagement of the stop tab 158 with the stop 160 of the stop tab-receiving slot 206, illustrated in FIG. 9, and in the upward direction 220 by the release button 194, illustrated in FIG. 8 and described below.

The release button 194 includes a top cylindrical portion 210 and a button stop 212. The button-receiving aperture 176 of the base 156 is sized to receive the top cylindrical portion 210 of the release button 194 but the button stop 212 is sized to be too large to penetrate the button-receiving aperture 176. The release button 194 is arranged so that the top cylindrical portion 210 protrudes through the button-receiving aperture 176 when the T-shaped restraint bar 58 is in the child-restraining position as shown, for example, in FIG. 8.

When the top cylindrical portion 210 of the release button 194 is protruding through the button-receiving aperture 176, the top cylindrical portion 210 engages the edge 174 of the wall 168 of the base 156. The engagement of the edge 174 and the release button 194 prevents the base 156 from rotating about the pivot axis 49 thereby locking the T-shaped restraint bar 58 into the child-restraining position.

The release button 194 further includes a top surface 214. When the release button 194 is fully contained inside the interior region 172 of the base 156 and the top surface 214 of the release button 194 engages the interior surface 170 of the wall 168 of the base 156, the base 156 is freely rotatable and the tip 154 of the post 144 can swing easily between the child-restraining position and the child-releasing position about the pivot axis 49. The top surface 214 of the release button 194 engages and rides along the interior surface 170 of the wall 168 of the base 156 as the post 144 swings.

The post 144 can swing in the downward direction 218 until the stop tab 158 engages the stop 160 in the seat shell 28 illustrated in FIG. 9, and the post 144 can swing in the upward direction 220 until the button-receiving aperture 176 in the base 156 is coincident with the release button 194. When the button-receiving aperture 176 is coincident with the release button 194, the spring 192 urges the release button 194 radially outwardly to the post-locking position illustrated in FIG. 8, so that the top cylindrical portion 210 protrudes through the button-receiving aperture 176. The button stop 212 engages the interior surface 178 of the wall 168 of the base 156 to halt the outward movement of the release button 194 and to contain the release button 194 within the button container 185. When the release button 194 is in the post-locking position, the top cylindrical portion 210 engages the edge 174 of the button-receiving aperture 176 of the base 156 to halt the rotating movement of the base 156 as previously discussed.

If the care giver wishes to move the T-shaped restraint bar 58 from the child-restraining position shown in FIGS. 1 and 8 to the child-releasing position shown in FIG. 9, the care giver depresses the release button 194 to move the top surface 214 of the release button 194 below the interior surface 170 of the wall 168 of the base 156 to disengage the top cylindrical portion 210 of the release button 194 from the edge 174 of the button-receiving aperture 176. Once the top cylindrical portion 210 of the release button 194 disengages from the edge 174 of the button-receiving aperture 176, the T-shaped restraint bar 58 is freely rotatable between the child-restraining position and the child-releasing position.

If the care giver were to release the release button 194 without moving the T-shaped restraint bar 58 away from the child-restraining position, the spring 192 would urge the release button 194 radially outwardly so that the top cylindrical portion 210 would once again engage the edge 174 of the button-receiving aperture 176, locking the T-shaped restraint bar 58 in the child-restraining position. If instead, the care giver rotates the post 144 away from the child-restraining position without releasing the release button 194, the top surface 214 of the release button 194 will engage the interior surface 170 of the wall 168 of the base 156 as the T-shaped restraint bar 58 swings freely to any position between the child-restraining position and the child-releasing position.

When the care giver wishes to move the post 144 from the child-releasing position to the child-restraining position, the care giver swings the post 144 toward the child-restraining position. The top surface 214 of the release button 194 engages the interior surface 170 of the wall 168 of the base 156, as shown, for example, in FIG. 9.

When the button-receiving aperture 176 travels to the point where it is positioned directly above the release button 194, the spring 192 urges the release button 194 radially outwardly to the post-locking position illustrated in FIG. 8, thereby bringing the top cylindrical portion 210 into engagement with the edge 174 of the button-receiving aperture 176 in the base 156. Further rotation of the T-shaped restraint bar 58 in either the upward direction 220 or the downward direction 218 is prevented by the engagement of the top cylindrical portion 210 with the edge 174 of the button-receiving aperture 176 in the base 156 thereby locking the post 144 into the child-restraining position.

As previously discussed, once the child (not shown) is seated on the seat bottom 30 of the seat shell 28 and the T-shaped restraint bar 58 is swung to the child-restraining position, the seat back 40 of the seat back shell 38 may be pivoted to adjust the position of the child. The seat back shell 38 is mounted to rotate to the seat shell 28 so that the seat back shell 38 rotates relative to the seat shell 28, as shown, for example, in FIGS. 10 and 11. The seat shell 28 includes a wall 80 arranged to define the seat bottom 30, the side arms 46, a proximal end 240 of the seat shell 28, a distal end 242 of the seat shell 28, the top surface 200 of the seat shell 28, and a nesting surface 246 on the bottom wall 82 adjacent to the proximal end 240 illustrated in FIGS. 6, 10, and 11.

The seat shell 28 includes a pivot axis 248 that lies in spaced-apart relation to the seat bottom 30 and is arranged to intersect both side arms 46. The pivot axis 248 is coincident with the pivot axis 49 when the seat back shell 38 and the seat shell 28 are coupled. The nesting surface 246 is arranged to curve along an arc having a radius 250 that is constant about the pivot axis 248 shown in FIG. 11.

Figure 10:
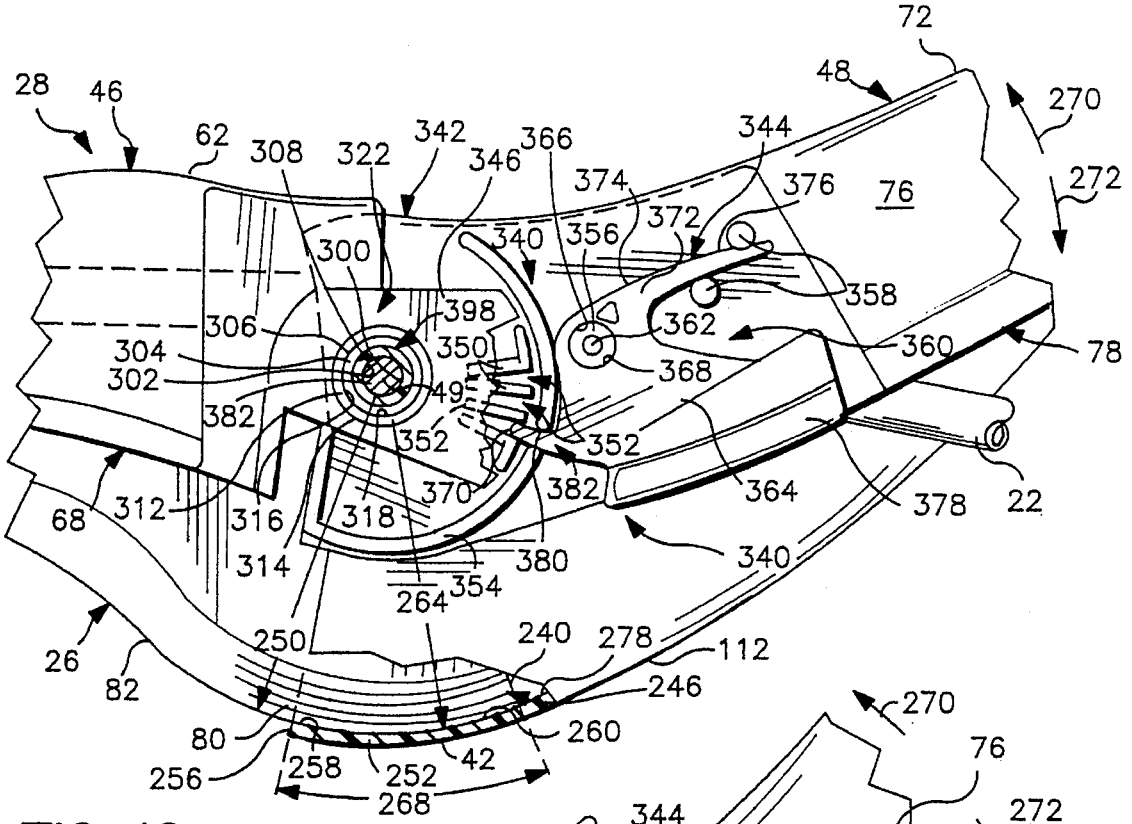
FIG. 10 is a side view of the child seat of FIG. 1 with a portion broken away showing the seat back shell mounted for rotation to the seat shell and having a round four-layered axle centered about a pivot axis of the seat back shell, and a peg appended to the squared C-shaped spring assembly being received by a lower peg-receiving slot to lock the seat back of the seat back shell into a reclining position relative to the seat bottom of the seat shell.
Figure 11:
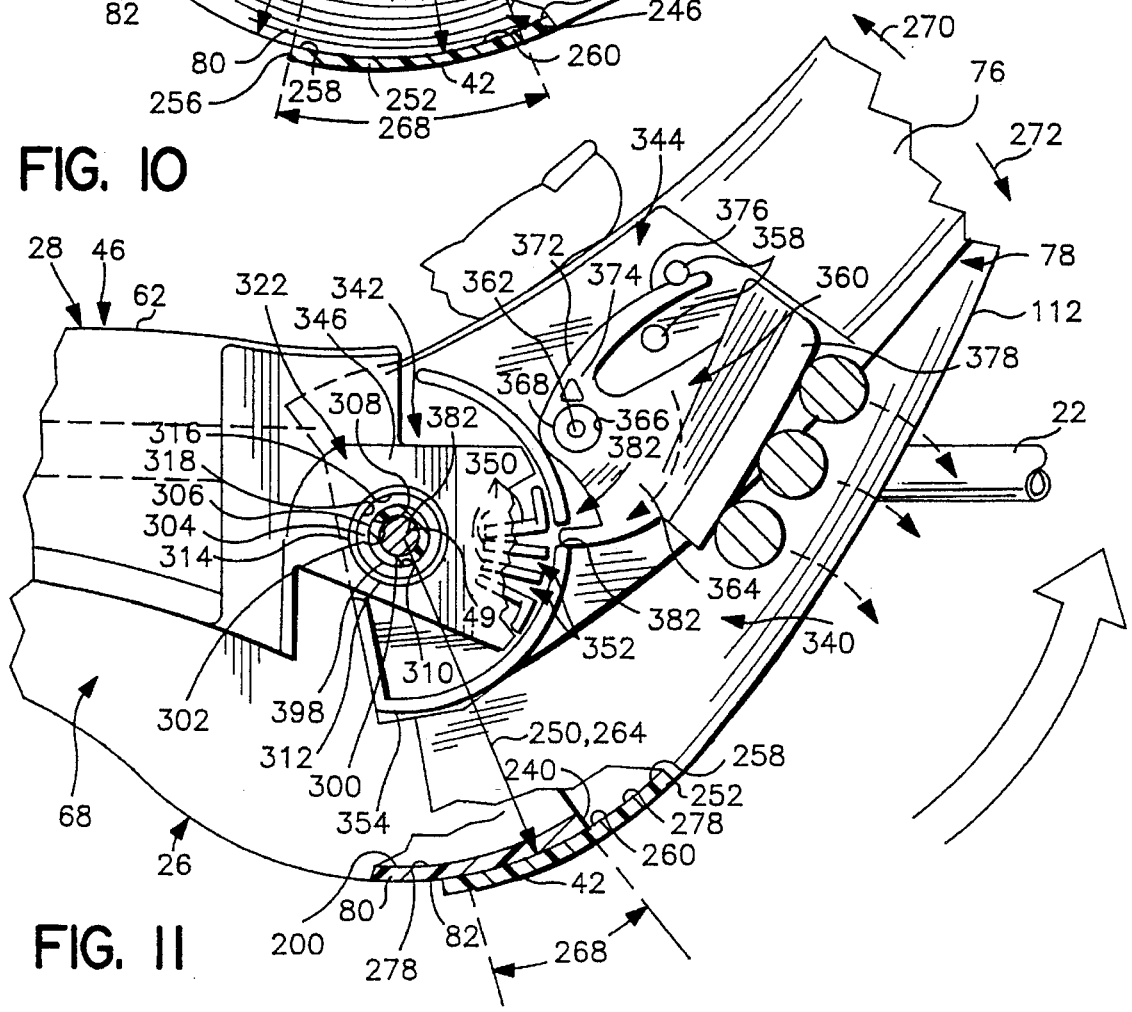
FIG. 11 is a view similar to FIG. 10 showing a handle on the spring assembly being squeezed to pull the peg from the peg-receiving slot, thereby releasing the seat back shell to rotate relative to the seat shell about the pivot axis.

The seat back shell 38 includes a wall 252 arranged to define the seat back 40, the side arms 48, a proximal end 254 of the seat back shell 38, a distal end 256 of the seat back shell 38, a top surface 258 of the wall 252 of the seat back shell 38, and a mating surface 260 of the top surface 258 adjacent to the distal end 256 illustrated in FIGS. 6, 10, and 11. The seat back shell 38 includes a pivot axis 262 that lies in spaced-apart relation to the seat back 40 and is arranged to intersect both side arms 48. The pivot axis 262 is coincident with both the pivot axis 248 and the pivot axis 49 when the seat back shell 38 and the seat shell 28 are coupled. The mating surface 260 is arranged to curve along an arc having a radius 264 that is constant about the pivot axis 262 as shown in FIG. 11, and is arranged to define a shell-receiving cavity 266 on the distal end 256 of the seat back shell 38, as shown in FIG. 6.

The seat back shell 38 is rotatably appended to the seat shell 28 so that the pivot axis 248 of the seat shell 28 and the pivot axis 262 of the seat back shell 38 coincide with the pivot axis 49 of the child seat 12. The nesting surface 246 of the seat shell 28 is received by the shell-receiving cavity 266 of the seat back shell 38 and engages the mating surface 260 of the seat back shell 38, as shown in FIGS. 10 and 11. The nesting and mating surfaces 246, 260 are arranged so that the surfaces 246, 260 are in full engagement when the child seat 12 is in the fully reclined position illustrated in FIG. 10. The mating surface 260 and the top surface 200 of the seat shell 28 cooperate to provide an essentially smooth and continuous seating surface 278 for the child.

As the care giver pivots the seat back shell 38 relative to the seat shell 28 from the reclined position illustrated in FIG. 10, to the upright position illustrated in FIG. 11, the nesting surface 246 slides over the mating surface 260. Though the overlapping area 268 of the nesting surface 246 and the mating surface 260, shown in FIGS. 10 and 11, decreases as the seat back shell 38 moves in an upward direction 270 to the upright position, the nesting and mating surfaces 246, 260 remain in full engagement in the overlapping area 268 through the full range of movement of the seat back shell 38 relative to the seat shell 28.

Advantageously, as the seat back shell 38 is pivoted relative to the seat shell 28, the top surface 200 of the seat shell 28 and the top surface 258 of the seat back shell 38 cooperate to present the essentially smooth and continuous seating surface 278 for a child (not shown) seated in the child seat 12. The top surface 200 and the top surface 258 are arranged so that adjustments of the seat back shell 38 are essentially imperceptible underneath a child seated in the child seat 12 so that the only change noticed by the child is the child's change of position. Additionally, the smooth and continuous nature of the seating surface 278 will help to prevent a young child that is unable to support itself from slipping toward the front edge 32 of the seat bottom 30 and slouching in the child seat 12 after adjustments are made to the seat back shell 38 and the seat back 40.

In preferred embodiments, the nesting surface 246 and the mating surface 260 are curved in a transverse direction 274 in addition to being curved along a longitudinal dimension 276 achieved by the curvature of the nesting and mating surfaces 246, 260 about the pivot axes 248, 262. However, it is within the scope of the invention as presently perceived to provide the nesting and mating surfaces 246, 260 with any desired shape in the transverse direction 274.

The seat back shell 38 is pivotably mounted to the seat shell 28 by two axles 280. Illustratively, the axles 280 include a proximal end formed to include a head 282 and a distal end 284 formed to include threads 286. The threads 286 on the distal end 284 of each axle 280 are arranged to be received by a nut 288 having an interior surface 290 formed to include threads 292 arranged to match the threads 286 of the axle 280, as shown in FIG. 6. Though threaded axles 280 are disclosed, it is within the scope of the invention as presently perceived to provide axles 280 made from rivets or from any other rod that can be appended to the child seat 12 in a suitable manner.

An interior annular wall 294 is integrally appended to a cover plate 296. The interior annular wall 294 includes an exterior surface 298 and an interior surface 300 arranged to define an axle-receiving aperture 302 centered about the pivot axis 49. An intermediate annular wall 304 is integrally appended to the outer side wall 76 of the seat back shell 38. The intermediate annular wall 304 includes an exterior surface 306 and an interior surface 308 arranged to define an interior annular wall-receiving aperture 310 centered about the pivot axis 49. An exterior annular wall 312 is integrally appended to the outer side wall 66 of the seat shell 28. The exterior annular wall 312 includes an exterior surface 314 and an interior surface 316 arranged to define an intermediate annular wall-receiving aperture 318 centered about the pivot axis 49.

Referring now to FIGS. 6, 10, and 11, the axles 280 are received by the axle-receiving apertures 302 of the interior annular walls 294 and covers 320 are snap-fit to the cover plates 296 over the axles 280. The interior annular walls 294 are received by the interior annular wall-receiving apertures 310 of the intermediate annular walls 304. The intermediate annular walls 304 are received by the intermediate annular wall-receiving apertures 318 of the exterior annular walls 312. Four structural members—the axles 280, the interior annular walls 294, the intermediate annular walls 304, and the exterior annular walls 312—are in engagement about the pivot axis 49 providing strength and support to an axle assembly 322.

During use, when the care giver pivots the seat back shell 38 relative to the seat shell 28, for each axle assembly 322 the intermediate annular wall 304 appended to the seat back shell moves relative to the exterior annular wall 312 appended to the seat shell 28. The axle 280 remains stationary relative to the interior annular wall 294, and the interior annular wall 294 remains stationary relative to the intermediate annular wall 304.

Advantageously, the exterior surface 306 of the intermediate annular wall 304 and the interior surface 316 of the exterior annular wall 312 are the only engaged surfaces in each axle assembly 320 that are in relative motion. The interior surface 316 and the exterior surface 306 are the two largest surfaces in each axle assembly 320 and as a result are the surfaces of each axle assembly 322 most capable of enduring wear brought about by movement of the seat back shell 38 relative to the seat shell 28.

The child seat 12 of the present invention further includes two seat back-locking mechanisms 340 illustrated in FIGS. 6, 10, and 11. Each seat back-locking mechanism 340 includes a notch assembly 342 that is integrally appended to the seat shell 28 and a peg assembly 344 that is integrally appended to the seat back shell 38.

Each notch assembly 342 includes a wall 346 that is formed to include an edge which is a portion of what was previously defined as the interior surface 316 of the exterior annular wall 312. Elongated teeth 350 are appended to the wall 312 and are aligned to extend radially outwardly from the pivot axis 49. The teeth 350 are positioned in spaced-apart relation and are arranged to define peg-receiving notches 352 between the teeth 350. The peg-receiving notches 352 extend radially outwardly from the pivot axis 49.

Each peg assembly 344 includes a peg-support ring 354 integrally appended to the outer side wall 76 of the seat back shell 38, a spring-pivot post 356 integrally appended to the outer side wall 76, two spring-retaining posts 358 integrally appended to the outer side wall 76, and a spring assembly 360 that is mounted to pivot about a pivot axis 362 defined by the spring-pivot post 356, as shown best in FIGS. 6, 10, and 11. The spring assembly 360 is movable between a seat back shell-locking position illustrated in FIG. 10 and a back-shell unlocking position illustrated in FIG. 11.

The spring assembly 360 includes a wall 364 having an edge 366 that is arranged to define a post-receiving aperture 368. The spring-pivot post 356 is received by the post-receiving aperture 368. A peg 370 is appended to the wall 364 and is arranged to pivot about the pivot axis 362 between the seat back shell-locking position in which the peg 370 is received by a peg-receiving notch 352 as shown in FIG. 10, and the seat back shell-releasing position in which the peg 370 is fully disengaged from the peg-receiving notches 352 as shown in FIG. 11.

The peg-support ring 354 includes two edges 380 arranged to define a slot 382 that is sized to receive the peg 370. The edges 380 of the peg support ring 354 engage the peg 370 and provide additional support to the peg 370 to resist movement of the seat back shell 38 relative to the seat shell 28 when the peg 370 is in the seat back shell-locking position.

A living spring 372 is appended to the wall 364 and is arranged to bias the spring assembly 360 to the seat back shell-locking position. The living spring 372 is made from a resilient material and includes a proximal end 374 appended to the wall and a stem 376 that is threaded between and in engagement with the spring-retaining posts 358.

A handle 378 is appended to the wall 364 and is arranged to pivot the spring assembly 360 to the seat back shell-releasing position when the care giver squeezes the handle 378 as shown in FIG. 11. Once the care giver releases the handle 378, the living spring 372 urges the spring assembly 360 back to the seat back shell-locking position with the peg 370 received by one of the peg-receiving notches 352.

The spring assembly 360 disclosed is of unitary assembly and is made of a resilient material. Though this is the preferred embodiment of the spring assembly 360, it is also within the scope of the invention as presently perceived to provide a spring assembly made from discrete components including a discrete peg, a discrete spring that is arranged to bias the discrete peg to a seat back shell-locking position, and a discrete handle arranged to pivot the discrete peg to a seat back shell-releasing position.

If the care giver wishes to adjust the position of the seat back 40 relative to the seat bottom 30, the care giver first grasps the child seat 12 using both hands, placing one hand on each side arm 48 of the seat back shell 38 adjacent to the seat back-locking mechanism 340 and the fingers of the care giver positioned to engage the handles 378. The care giver squeezes the handles 378 to pivot the spring assembly 360 to the seat back shell-unlocking position disengaging the peg 370 from the peg-receiving notch 352. Once the peg 370 disengages the peg-receiving notch 352, the seat back shell 38 is freely rotatable between the upright position and the reclining position relative to the seat shell 28.

If the care giver were to release the handles 378 without adjusting the seat back shell 38, the living spring 372 would urge the spring assembly 360 back to the seat back shell-locking position so that the peg 370 would once again engage the same peg-receiving notch 352, locking the seat back shell 38 relative to the seat shell 28. If instead, the care giver pivots the seat back shell 38 and then releases the handles 378, the seat back shell 38 will pivot to a new position. When the peg 370 is once again coincident with a peg-receiving notch 352, the living spring 372 will urge the spring assembly 370 to the seat back shell-locking position and the peg 370 will enter the peg-receiving notch 352, once again locking the seat back 40 relative to the seat bottom 30.

Although the invention has been described in detail with reference to a preferred embodiment, variations and modifications exist within the scope and spirit of the invention as described and defined in the following claims.

I claim:

1. A child seat having an adjustable seat back, the child seat comprising a seat shell formed to include a seat bottom having a front edge and a back edge, a seat back shell pivotably appended to the back edge and extending upwardly therefrom, the seat back shell being arranged to pivot about a pivot axis, and a peg mover including a peg integrally appended to a peg-release handle and a living spring integrally appended to the peg-release handle and the peg, the peg mover being mounted to the seat back shell and arranged so that the peg reciprocates in a direction perpendicular to the pivot axis between a seat back shell-locking position and a seat back shell-releasing position, the living spring yieldably biasing the peg toward the seat back shell-locking position.

2. The child seat of claim 1, wherein the living spring is cantilevered to the peg mover and the living spring has a first end appended to the peg mover and a second end engaging posts appended to the seat back shell.

3. The child seat of claim 1, wherein the seat back shell can be locked relative to the seat shell in a plurality of positions relative to the seat shell.

4. The child seat of claim 3, wherein the plurality of positions includes at least three positions in which the seat back shell can be locked relative to the seat shell.

5. The child seat of claim 1, wherein the seat shell further includes a pivot hub defining the pivot axis and the pivot hub includes two teeth arranged to define a peg-receiving notch receiving the peg when the peg is in the seat back shell-locking position.

6. The child seat of claim 5, wherein the teeth are radially directed teeth and the peg-receiving notch defined therebetween is radially directed.

7. The child seat of claim 5, wherein the pivot hub is integrally appended to the seat shell.

8. The child seat of claim 1, wherein the peg mover is mounted to the seat back to pivot relative to the seat back about a second pivot axis spaced apart from the pivot axis of the seat back shell when the peg-release handle moves between the seat back shell-releasing position and the seat back shell-locking position, the peg-release handle being arranged to pull the peg away from the seat back shell-locking position and to the seat back shell-releasing position when the peg-release handle is moved to the seat back shell-releasing position.

9. The child seat of claim 8, wherein the living spring is cantilevered to the peg mover and has a first end and a second end, the first end being appended to the peg mover adjacent to the second pivot axis and the second end being braced relative to the seat back shell.

10. The child seat of claim 9, wherein the second end engages posts appended to the seat back shell to brace the second end relative to the seat back shell.

11. The child seat of claim 8, wherein the peg-release handle rotates toward the living spring when the peg-release handle moves to the seat back shell-releasing position.

12. The child seat of claim 11, wherein the living spring yieldably biases the handle toward the seat back shell-locking position and rotates the handle to the seat back shell-locking position when the living spring moves the peg to the seat back shell-locking position.

13. The child seat of claim 11, wherein the peg rotates toward the living spring about the second pivot axis when the handle moves to the seat back shell-releasing position to move the peg to the seat back shell-releasing position.

14. The child seat of claim 1, wherein the child seat further includes a post including a base, a tip, and a stop tab appended to the base, the base being rotatably mounted to the seat shell and arranged so that the tip swings between a child-restraining position above the seat bottom and a child-releasing position having the stop tab in engagement with the seat shell.

15. The child seat of claim 14, further including means for locking the post in the child-restraining position, and the locking means includes a button arranged to lock the post in the child-restraining position and to unlock the post when the button is activated.

16. The child seat of claim 15, wherein the button is positioned to lie adjacent to the front edge.

17. The child seat of claim 15, wherein the button is positioned to lie in the base of the post.

18. A child seat having an adjustable seat back arranged to pivot relative to a seat bottom between an upright position and a reclined position, the child seat comprising a seat shell having a proximal end and a distal end, the seat shell being formed to include a seat bottom, a first pivot axis adjacent to the proximal end and lying in spaced-apart relation to the seat bottom, and a bottom surface formed to include a nesting surface appended to the proximal end, the nesting surface being arranged to curve along an arc having a radius that is constant about the first pivot axis, and a seat back shell having a proximal end and a distal end, the seat back shell being formed to include a seat back, a second pivot axis adjacent to the distal end and lying in spaced-apart relation to the seat back, and a top surface having a mating surface appended to the distal end, the mating surface being arranged to curve along an arc having a radius that is constant about the second pivot axis thereby defining a shell-receiving cavity adjacent to the distal end of the seat back shell, the seat back shell being rotatably appended to the seat shell with the proximal end of the seat shell being positioned to lie in the shell-receiving cavity, the first pivot axis being coincident with the second pivot axis, and the nesting surface engaging the mating surface.

19. The child seat of claim 18, wherein the first and second pivot axes extend in a transverse direction across the seat shell and the seat back shell, the child seat includes a longitudinal dimension that is perpendicular to the transverse direction, and the nesting surface and the mating surface remain in engagement in the transverse direction where the nesting and mating surfaces remain in engagement in the longitudinal dimension as the seat back pivots between the upright position and the reclined position.

20. The child seat of claim 18, wherein the seat back shell is arranged to pivot about the second pivot axis, the child seat further includes an interior annular wall formed to include an interior axle-receiving aperture centered around the second pivot axis, the seat back shell further includes an intermediate annular wall having an interior surface arranged to engage the interior annular wall, the seat shell further includes an exterior annular wall having an interior surface arranged to engage the intermediate annular wall, and the child seat further includes an axle received by the axle-receiving aperture.

21. The child seat of claim 20, wherein the intermediate annular wall moves relative to the exterior annular wall and the interior annular wall and the axle remain stationary relative to the intermediate annular wall when the seat back shell pivots relative to the seat shell.

22. The child seat of claim 21, wherein the seat shell further includes a notch assembly positioned to lie adjacent to the first pivot axis, the notch assembly includes two teeth arranged to define a peg-receiving notch, and the exterior annular wall is integrally appended to the notch assembly.

23. A child seat having an adjustable back, the child seat comprising a seat shell formed to include a seat bottom having a front edge and a back edge, a seat back shell mounted to the back edge and extending upwardly therefrom, the seat back shell mounted to pivot relative to the seat bottom about a pivot axis, the seat back shell being formed to include a seat back, and retaining means appended to the seat shell and the seat back shell for fixing the seat back in any of a plurality of retained positions about the pivot axis relative to the seat bottom, the retaining means including a peg coupled to the seat back shell and a pivot hub mounted to the seat shell and defining the pivot axis of the seat back shell, the hub being formed to include a plurality of slots having openings that are radially directed relative to the pivot axis positioned to receive the peg.

24. The child seat of claim 23, wherein the plurality of slots includes at least three slots so that the seat back shell can be locked in at least three positions relative to the seat shell.

25. The child seat of claim 23, wherein the peg is movable to a seat back shell-locking position in which the seat back is fixed relative to the seat bottom and a seat back shell-releasing position in which the seat back is pivotable relative to the seat bottom, and the retaining means further includes handle means appended to the seat back shell for moving the peg to the seat back shell-releasing position.

26. The child seat of claim 25, wherein the retaining means includes means for urging the peg to the seat back shell-locking position.

27. The child seat of claim 26, wherein the peg and handle means are of unitary construction.

28. The child seat of claim 23 wherein the pivot hub is formed to include radially directed teeth defining the radially directed slots therebetween.

29. The child seat of claim 28, wherein the radially directed teeth define at least three radially directed slots so that the seat back shell can be fixed in at least three positions relative to the seat shell.

30. The child seat of claim 28, wherein the pivot hub is integrally appended to the seat shell.

31. The child seat of claim 30, wherein the pivot hub includes an axially outer wall covering the radially directed teeth so that the wall and the teeth cooperate to define the slots, the wall covering the slots.

32. A child seat for a swing, the child seat comprising a seat shell formed to include a seat bottom having a front edge, a back edge, and a wall formed to include a generally downwardly-facing bottom surface underneath the seat shell, a seat back appended to the back edge of the seat shell and extending upwardly therefrom, and a support-receiving structure appended to the bottom surface and extending generally downwardly therefrom, the support-receiving structure including a U-shaped bridge and an inverted U-shaped bracket spaced apart from the U-shaped bridge.

33. The child seat of claim 32, wherein the seat shell has a top side and a bottom side, the seat bottom is appended to the top side, and the support-receiving structure is appended to the bottom side.

34. The child seat of claim 32, wherein the seat bottom further includes two spaced-apart side edges, a side arm is appended to each side edge and extends upwardly therefrom, the support-receiving structure is a first support-receiving structure and is appended to the first side arm, and further comprising a second support-receiving structure including a U-shaped bridge and an inverted U-shaped bracket appended to the second side arm.

35. The child seat of claim 34, wherein each side arm includes a top side and a bottom side and the first and second support-receiving structures are appended to the bottom sides of the respective side arms.

36. The child seat of claim 32, wherein the seat bottom further includes first and second spaced-apart sides and the child seat further comprises a second support-receiving structure, the first support-receiving structure being appended to the bottom surface adjacent to the first side and the second support-receiving structure being appended to the bottom surface adjacent to the second side.

37. The child seat of claim 36, wherein each support-receiving structure includes a second U-shaped bridge and a second inverted U-shaped bracket, the second bridge being positioned to lie between the first bridge and the first bracket and in spaced-apart relation to the first bridge, and the second bracket being positioned to lie in spaced-apart relation to the first bridge having the first bridge between the second bridge and the second bracket.

38. A child seat having a child restraint apparatus, the child seat comprising a shell formed to include a seat bottom having a front edge and a back edge, a seat back appended to the back edge and extending upwardly therefrom, a post including a base, a tip, and stop tab appended to the base, the base being rotatably mounted to the shell and arranged so that the tip swings between a child-restraining position above the seat bottom and a child-releasing position having the stop tab in engagement with the shell, and a button mounted in the post.

39. The child seat of claim 38, wherein the base defines a generally cylindrical space having a central axis generally coincident with the axis of rotation of the base and the button-is mounted inside the post and is generally positioned to lie inside of the generally cylindrical space.

40. The child seat of claim 38, wherein the post further includes an exterior wall having an edge arranged to define a button-receiving aperture, the button includes a cylindrical side wall, and the button is arranged so that the cylindrical side wall engages the edge of the aperture when the post is in the child-restraining position.

41. The child seat of claim 38, herein the post further includes a wall having an interior surface, the button includes a top, and the button is arranged so that the top engages the interior surface when the post is not in the child-restraining position.

42. The child seat of claim 38, wherein the post further includes an elongated transverse cross member appended to the tip and arranged to lie in perpendicular relation to the post.

43. The child seat of claim 42, wherein the cross member includes a tray having a top wall formed to include a horizontal surface and a circumferential lip.

44. The child seat of claim 38, wherein a cylindrical housing is fixed to the shell, the post includes a wall arranged to define the base, the wall of the base includes an interior surface arranged to define a cylindrical interior region, and the base is mounted to the housing so that the interior surface engages the housing and the base rotates about a pivot axis as the tip swings between the child-restraining position and the child-releasing position.

45. The child seat of claim 44, wherein the housing includes a wall arranged to define a button container, the button is positioned to lie in the button container and is biased outwardly away from the pivot axis, the button being arranged to reciprocate within the button container in a direction radially outwardly relative to the pivot axis.

46. The child seat of claim 45, wherein the button further includes a top, an upper cylindrical side wall, and a stop, and the wall of the base further includes an interior surface and an edge arranged to define an aperture sized to receive the upper cylindrical side wall of the button and sized to be smaller than the stop of the button, the button being arranged so that the upper cylindrical side wall engages the edge when the post is in the child-restraining position and so that the top of the button engages the interior surface when the post is not in the child-restraining position.

* * * * *